US007165564B2

(12) United States Patent
Kamm

(10) Patent No.: US 7,165,564 B2
(45) Date of Patent: Jan. 23, 2007

(54) DEVICE FOR CLEANING INSTALLATIONS AND RELATED METHODS

(75) Inventor: Volker Kamm, Taufkirchen (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 10/701,078

(22) Filed: Nov. 5, 2003

(65) Prior Publication Data

US 2004/0144404 A1 Jul. 29, 2004

Related U.S. Application Data

(63) Continuation of application No. PCT/EP02/04824, filed on May 2, 2002.

(30) Foreign Application Priority Data

May 5, 2001 (DE) ..... 101 21 931

(51) Int. Cl.
*B08B 3/02* (2006.01)

(52) U.S. Cl. ..... 134/131; 134/144; 134/148; 134/176; 134/179

(58) Field of Classification Search ..... 134/131, 134/130, 144, 148, 151, 176, 179
See application file for complete search history.

(56) References Cited

U.S. PATENT DOCUMENTS 3,155,102 A * 11/1964 Niederer, Jr. et al. ..... 134/72
4,141,754 A * 2/1979 Frauenfeld ..... 134/24
4,944,320 A * 7/1990 Waite et al. ..... 134/167 C
5,265,671 A 11/1993 Vowles
5,365,671 A * 11/1994 Yaniger ..... 33/366.12
5,402,809 A * 4/1995 Smith ..... 134/129
5,438,840 A 8/1995 Barber, III et al.
5,622,196 A * 4/1997 Luongo ..... 134/72
6,402,854 B1 * 6/2002 Horridge ..... 134/8

FOREIGN PATENT DOCUMENTS

| | | |
|---|---|---|
| DE | 2453673 | 5/1979 |
| DE | 2526323 | 12/1979 |
| EP | 0958849 | * 11/1999 |
| EP | 1055462 | 11/2000 |

OTHER PUBLICATIONS

International Search Report.

* cited by examiner

*Primary Examiner*—Michael Barr
*Assistant Examiner*—Saeed Chaudhry
(74) *Attorney, Agent, or Firm*—Crowell & Moring LLP

(57) ABSTRACT

A device having at least one cleaning unit for cleaning installations, especially for the production and/or processing of food stuffs or pharmaceuticals is provided. The device may include a cleaning unit that is configured to move within the installation to be cleaned. The cleaning unit may also be provided with one or more nozzles with rotatable nozzle tips configured to rotate as cleaning agent flows through the nozzle tip.

24 Claims, 2 Drawing Sheets

DEVICE FOR CLEANING INSTALLATIONS AND RELATED METHODS

CROSS-REFERENCE TO RELATED APPLICATIONS

This application is a continuation of International Patent Application No. PCT/EP02/04824, filed May 2, 2002, designating the United States of America, and published in German as WO 02/090007, the entire disclosure of which is incorporated herein by reference. Priority is claimed based on Federal Republic of Germany Patent Application No. DE 101 291 931.8, filed May 5, 2001.

FIELD OF THE INVENTION

In certain embodiments, the present invention relates to a device having at least one cleaning unit for cleaning installations for the production and/or processing of foodstuffs or pharmaceuticals.

BACKGROUND OF THE INVENTION

Installations for the production and/or processing of foodstuffs or pharmaceuticals, i.e., installations with high hygienic requirements, are normally cleaned manually during breaks in operation. Problems typically occur in the process, however, since these installations are often very difficult for the cleaning personnel to access and the installations include a plurality of parts built within a narrow space. Moreover, the quality of the cleaning depends, above all, on the care of the personnel and is consequently subject to undesired variations.

Different, automated cleaning systems are known, for example, nozzles, fixed within the installation, that spray a cleaning agent. In these systems, the ability to clean all corners and angles in the equipment can be limited. As a rule, there are so-called cleaning shadows, which are areas that are not reached during the cleaning. In order to eliminate such areas, a large number of nozzles and feeding pipes for cleaning agents are required, resulting in a complex system that is costly to maintain. Moreover, in systems with fixed nozzles, cleaning the surfaces of the cleaning system itself is required since the cleaning system must be regarded as part of the installation and is therefore subject to the elevated hygienic requirements of the rest of the installation.

SUMMARY OF THE INVENTION

One object of the present invention is to provide a simple and maintenance-friendly cleaning system that also fulfills high hygienic requirements of, for example, the production and/or processing of foodstuffs or pharmaceuticals.

These objects are achieved with a cleaning unit which is configured so that it can move through the installation to be cleaned. The cleaning unit is also configured so that it can be supplied with a cleaning agent via a flexible connection.

For purposes of the present disclosure, cleaning agents means all agents to which a cleaning effect may be ascribed, in particular water, water-washing powder mixtures or solutions, foams, gases, and gas mixtures (e.g., air). Where the cleaning agent is a foam, the foam is preferably made by adding gas (e.g., nitrogen) to water and washing powder.

In certain embodiments, the cleaning unit includes at least one nozzle for the output cleaning agents. In certain particularly preferred embodiments, the cleaning unit includes at least one nozzle tip for the output of cleaning agents, preferably a nozzle tip that carries out a rotational movement when driven by the flow of the cleaning agent. Through this rotational movement, an area of 360° around the nozzle tip may be covered. Alternatively, swivelable nozzle tips may also be used.

In certain preferred embodiments, the cleaning unit includes a conveyance system, or some alternative means of conveyance. Preferably the conveyance system or means of conveyance is designed as a carriage. A guide system is preferred as a guide for the means of conveyance. In certain preferred embodiments, the guide system includes at least one guide rail. The carriage preferably includes wheels that are guided by the guide rail. As a result, movement of the carriage is possible, with minimal frictional losses. Such a carriage may also be referred to as a trolley.

In certain embodiments of the invention, two parallel safety rails are provided for the carriage.

In certain embodiments of the invention, a park position is provided for the conveyance system or means of conveyance in the interior of the installation, on which the conveyance system or means of conveyance is parked during the production and/or processing of foodstuffs or pharmaceuticals. In this way, the conveyance system or means of conveyance may remain in the hygienic environment all the time. The conveyance system or means of conveyance does not need to be brought into the installation before each cleaning phase, and it does not need to be removed from the installation after each cleaning phase. All connections on the cleaning unit may remain connected. In this way, the cleaning unit is immediately usable at any time.

In certain embodiments, a driving gear is advantageously provided for moving the cleaning unit. Preferably, the driving gear is installed outside of the installation to be cleaned, and the driving gear is connected to the cleaning unit via a power transmission element. An electric driving gear is preferably provided. A pneumatic or a hydraulic driving gear may also be used.

In certain preferred embodiments, a chain is provided as a power transmission element. The chain is preferably a non-lubricated special steel chain. The use of a non-lubricated special steel chain is particularly suitable for installations with very high hygienic requirements. In another embodiment of the present invention, a strap or, for example, a plastic-coated wire cable, is provided as a power transmission element.

According to certain preferred embodiments of the present invention, the cleaning unit is connected to a source for the cleaning agent via a flexible connection. A tube, in particular a flexible plastic tube, is preferably provided as the flexible connection.

In certain embodiments of the present invention, a mechanism or means for changing the length of the flexible connection in the interior of the installation to be cleaned is provided. The mechanism or means for changing the length of the flexible connection adapts the flexible connection to the movement of the cleaning unit. A roller is preferably provided as the mechanism or means for changing the length of the flexible connection in the interior of the installation to be cleaned. The roller is preferably connected to a driving gear. In certain embodiments, the roller is axially movable.

In certain preferred embodiments, the roller is subjected to a forced movement in an axial direction. The forced movement causes the flexible connection, for example a tube, to lie beside the preceding coil of the tube as or each time the roller rotates. With every rotation of the roller, it is consequently possible to coil or uncoil a constant length of the tube. These embodiments exhibit the particular advantage of considerably simplifying the synchronization of the rotating speed of the roller with the speed of the movement of the cleaning unit.

In certain other embodiments of the invention, a bearing arrangement of the roller is configured as a screw thread, preferably a trapezoidal thread, even more preferably a multiplex trapezoidal thread, and a second bearing arrangement of the roller is designed as a torsion-proof sliding bearing arrangement. The ascending gradient of the trapezoidal thread is suitably coordinated with the diameter of the flexible connection or of the tube. The required ascending gradient of the thread rises as the diameter of the tube increases. A ball screw is also suitable as an alternative to the trapezoidal thread.

In certain embodiments of the invention, a shaft suitable for conducting cleaning agents is provided for the roller. In such embodiments, the cleaning agent flows through the shaft interior, which is advantageously configured as a hollow body.

In certain embodiments of the invention, exactly one driving gear is provided for driving the roller and for moving the cleaning unit. In these embodiments, the movement of the cleaning unit and the roller are advantageously automatically synchronized. The flexible connection is consequently coiled or uncoiled, always in accordance with the present position of the cleaning unit in the installation to be cleaned.

The present invention exhibits numerous other benefits and advantages.

Through the movement of the cleaning unit, cleaning shadows may be avoided. Theoretically, the movement of the cleaning unit simulates an effect that would be achieved by a nearly unlimited number of cleaning nozzles installed side-by-side. In one arrangement for the nozzle tip, a rotating nozzle tip is provided with several nozzles arranged at various angles to the rotational axis. This arrangement facilitates a very thorough cleaning without cleaning shadows. In the cleaning process, the cleaning unit itself, as well as the guide system, is included, meaning that these components are automatically thoroughly cleaned along with the device of the present invention.

In comparison with conventional, rigidly mounted cleaning systems, the investment costs for the cleaning components increase only marginally for large installations since the price of the movable cleaning unit remains the same irrespective of the spatial scope of the installation to be cleaned. At most, the length of the required flexible connection for providing the cleaning unit with cleaning agent as well as the length of the power transmission element (e.g., a chain) increases with the spatial scope of the installation. Still, these components involve relatively modest investment costs. In comparison with conventional cleaning systems, the investment costs are greatly reduced as a whole.

In certain embodiments, the device of the present invention exhibits an advantageously modest need for resources, such as water and washing powder, while simultaneously delivering excellent cleaning results.

Other objects, advantages and novel features of the present invention will become apparently from the following detailed description of the invention when considered in conjunction with the accompanying drawings.

BRIEF DESCRIPTION OF THE DRAWINGS

The present invention and certain particulars thereof are explained in detail in the following description with the help of an exemplary embodiment illustrated in the figures.

DETAILED DESCRIPTION OF THE DRAWINGS

Figure 1:
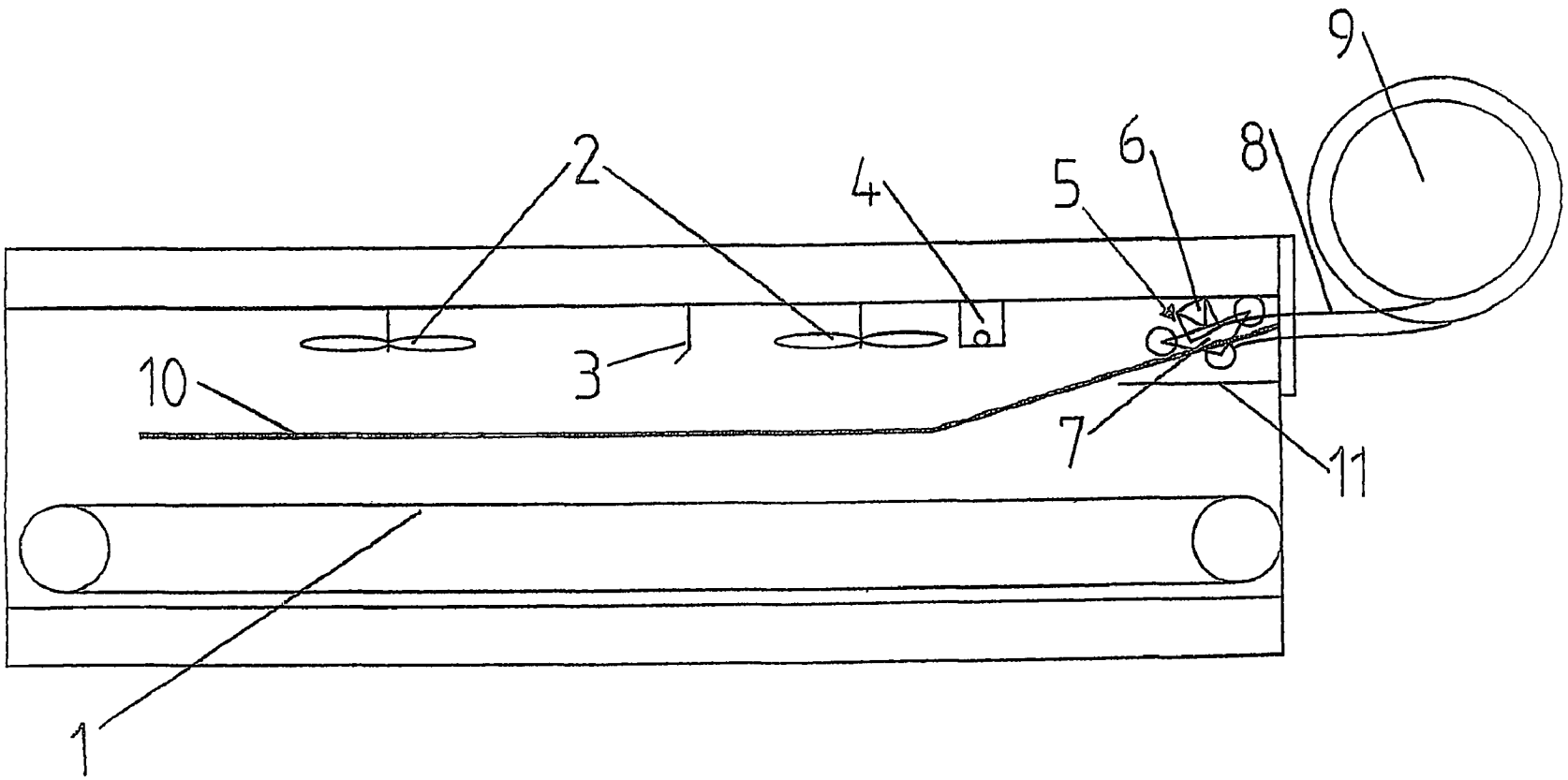
FIG. 1 is a lateral cross-section of an installation for the treatment of foodstuffs with a cleaning unit.
Figure 2:
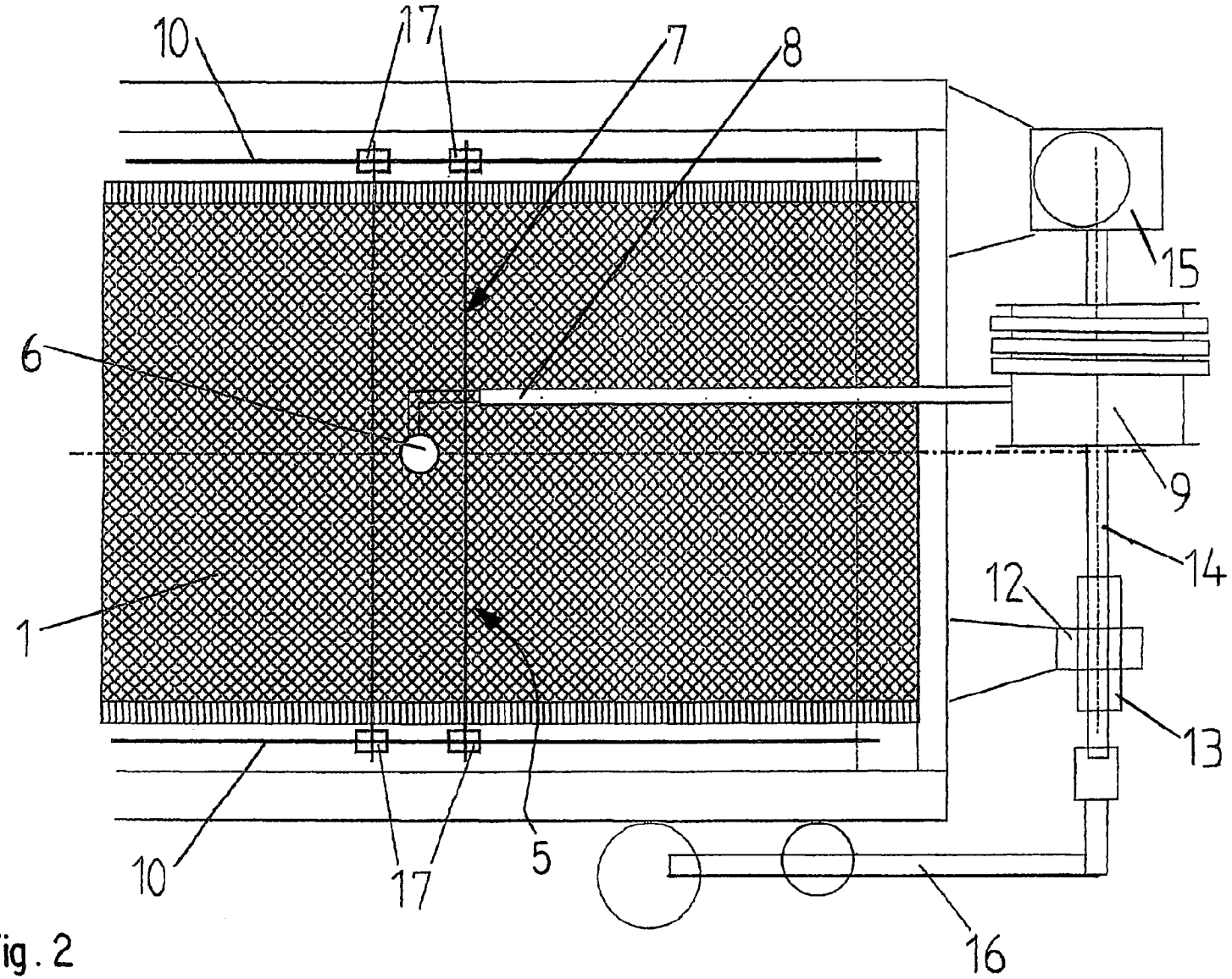
FIG. 2 is a top view of the interior of an installation for the treatment of foodstuffs with a cleaning unit similar to that shown in FIG. 1.

Referring to FIGS. 1 and 2, a flow-through system for freezing foodstuffs (e.g., a freezing tunnel) having a cleaning unit 5 according to certain embodiments of the invention is shown. The installation includes a conveyor belt 1 on which the foodstuffs are transported in the freezing operation and on which the highest impurity typically occurs. Above conveyor belt 1, the installation includes two guide rails 10 positioned to the left and right along the side wall. The cleaning unit 5 is movable left and right along guide rails 10.

Cleaning unit 5 includes as mechanism or means for conveying a carriage 7 on which a nozzle tip 6 is fastened, which is set into a rotational movement by the flow of the cleaning agent supplied via a tube 8. The tube 8 provides a flexible connection, or may serve as a flexible connector, and is coiled according to the present invention on a roller 9. The tube 8 connects cleaning unit 5 with a source for the cleaning agent (not shown). The tube 8 may be constructed from any suitable material, for instance plastic.

FIG. 1 also depicts an entry system 4 for the refrigerating agent (e.g., super cold nitrogen), which is fastened to the cover of the installation, as well as ventilators 2 also fastened to the cover, for circulating the atmosphere in the installation in the freezing operation. A guiding plate 3 is also provided.

To clean the installation (cleaning operation), cleaning unit 5 is moved back and forth at least once on the route prescribed by guide rails 10, during which time the cleaning agent comes out of the rotating nozzle tip 6 and rids the interior of the installation of impurities. Through the rotational movement, a 360° angle around the nozzle tip 6 may be cleaned. A rotating nozzle tip 6 is preferably provided with several nozzles arranged at different angles to the rotational axis, the nozzle tip 6 facilitating a thorough cleaning with no cleaning shadows.

Because of the arrangement of the components relative to one another, as illustrated in both figures, cleaning unit 5, guide tracks 10, and the chain (not shown) for transmitting the driving power to cleaning unit 5 are likewise cleaned simultaneously when the installation is cleaned.

Upon conclusion of the cleaning, and during the freezing operation in the installation, cleaning unit 5 may be placed in the park position shown in FIG. 1. The park position is additionally characterized by a plate 11 installed under cleaning unit 5 on the walls of the installation. The plate 11 is advantageously tilted and/or bent such that conveyor belt 1 is protected from cleaning unit 5, to prevent any cleaning agent from dripping from the cleaning unit 5 after the cleaning, onto the foodstuffs.

As an alternative to the described park position, where the interior of the installation provides limited space, the cleaning unit 5 may be advantageously parked outside of the installation.

In both cases, after the cleaning, the entire space is advantageously available in the region of conveyor belt 1 for the freezing operation and in particular for the foodstuffs to be frozen.

FIG. 2 shows a top view of the interior of an installation similar to that shown in FIG. 1 with guide rails 10 or tracks and a carriage 7 with wheels 17 which serve as the conducting link between guide rails 10 and the carriage 7. A nozzle tip 6 is fastened to carriage 7, and together they form a cleaning unit 5. Nozzle tip 6 is connected with a source for the cleaning agent via a flexible connection (e.g., tube 8, which may be plastic) which is connected to a feeding pipe 16 for the cleaning agent. In the cleaning process, tube 8 extends from and retracts onto a roller 9, which sits on a shaft 14. The shaft 14 is associated with a bearing arrangement 13 designed as a thread, and a torsion-proof sliding bearing arrangement (not shown in detail) on the sides of motor 15, which serves as a driving gear of roller 9. In the process, in this example, bearing arrangement 13 is provided as a multiplex trapezoidal thread with a great incline. The torsion-proof sliding bearing arrangement preferably includes a feather key. For bearing arrangement 13, a rotary transmission lead through 12 is provided, which is connected with the casing of the installation. Roller 9 is subjected to a force and moves in response thereto in an axial direction. In certain preferred embodiments, the forced movement causes tube 8 to lie beside the preceding coil of the tube 8 as roller 9 rotates. With every rotation of the roller, it is consequently possible to coil or uncoil a constant length of tube 8. These embodiments exhibit the particular advantage of considerably simplifying the synchronization of the rotating speed of roller 9 with the speed of the movement of cleaning unit 5.

In view of the hygienic requirements in the interior of the installation, it is advantageous for a majority of the components described in the last section to be installed on the outside of the installation. This helps to ensure that these components do not introduce any additional impurities or foreign matter into the installation. Moreover, space is not required within the installation for these components.

In certain embodiments, in order to synchronize the rotating speed of roller 9 with the speed of the movement of cleaning unit 5, a control system is provided, which ensures that during the entire cleaning process, tube 8 essentially connects roller 9 with cleaning unit 5 in the shortest manner. For this purpose, the control system coordinates the two driving gears to one another, of which only motor 15 is shown in FIG. 2. For example, the position of cleaning unit 5 is determined by automatically counting the chain links of the power transmission element and the rotating speed of roller 9 is controlled depending on the result. The rotating speed is altered in accordance with the region in which cleaning unit 5 moves since the speed of cleaning unit 5 also changes. In the vicinity of the front (park position) and rear turning point, it is as a rule lower than in the center of the distance to be covered.

According to another embodiment of the present invention, exactly one driving gear is provided for driving the roller 9 and for moving the cleaning unit such that the two movements described are synchronized.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A device for cleaning an installation for the production or processing of foodstuffs or pharmaceuticals, said device comprising:

at least one cleaning unit configured to move within the installation to be cleaned and adapted to clean essentially the whole inside surface of the installation wherein the production or processing of foodstuffs or pharmaceuticals takes place, said cleaning unit including a conveyance system and at least one nozzle configured to output a cleaning agent and at least one nozzle tip configured to output a cleaning agent wherein said nozzle tip is configured to be actuated in a rotational movement by a flow of cleaning agent;

a parked position for the cleaning unit in the interior of the installation, said parked position comprising a plate installed under said cleaning unit to prevent cleaning agent from dripping and said parked position being configured so that the cleaning unit may be parked thereupon during a production or processing of foodstuffs or pharmaceuticals; and a flexible connection configured to supply a cleaning agent to the cleaning unit and to move with a movement of the cleaning unit.

2. The device of claim 1, wherein the conveyance system is configured as a carriage.

3. The device of claim 1, further comprising a guide system for guiding the conveyance system.

4. The device of claim 3, wherein the guide system comprises at least one guide rail.

5. The device of claim 1, wherein said parked position is to prevent contamination of the foodstuffs or pharmaceuticals with cleaning agent.

6. The device of claim 1, further comprising a driving gear for moving the cleaning unit, said driving gear being connected to the cleaning unit with a power transmission element.

7. The device of claim 6, wherein said driving gear is positioned outside of the installation to be cleaned.

8. The device of claim 6, wherein said power transmission element comprises a chain.

9. The device of claim 8, wherein said chain is a non-lubricated steel chain.

10. The device of claim 1, wherein said flexible connection is a tube.

11. The device of claim 10, wherein said tube is constructed from plastic.

12. The device of claim 1, wherein said flexible connection connects the cleaning unit to a source for the cleaning agent.

13. The device of claim 1, further comprising a mechanism for changing the length of the flexible connection so as to adapt the flexible connection to the movement of the cleaning unit.

14. The device of claim 13, wherein said mechanism for changing the length of the flexible connection comprises a roller which is connected to a driving gear.

15. The device of claim 14, wherein the roller is axially moveable.

16. The device of claim 14, wherein the roller is configured to move in response to a force provided in an axial direction.

17. The device of claim 14, further comprising a first bearing arrangement for the roller and a second bearing arrangement for the roller.

18. The device of claim 17, wherein said first bearing arrangement is configured as a screw thread.

19. The device of claim 17, wherein said first bearing arrangement is configured as a trapezoidal thread.

20. The device of claim 17, wherein said first bearing arrangement is configured as a multiplex trapezoidal thread.

21. The device of claim 14, further comprising a shaft for the roller wherein said shaft is configured to conduct a cleaning agent.

22. The device of claim 14, wherein a single driving gear is provided for driving the roller and for moving the cleaning unit.

23. An installation for the production or processing of foodstuffs or pharmaceuticals comprising:

an interior space;

a conveyor belt for transporting foodstuffs or pharmaceuticals within the interior space; and the device for cleaning an installation for the production or processing of foodstuffs or pharmaceuticals of claim 1 said device for cleaning an installation for the production or processing of foodstuffs or pharmaceuticals of claim 1 being within the interior space.

24. The installation of claim 23, wherein said installation is a system for freezing foodstuffs and further comprises:

an entry system for a refrigerating agent.

* * * * *